US005401232A

United States Patent [19]

Sailas

[11] Patent Number: 5,401,232

[45] Date of Patent: Mar. 28, 1995

[54] ROLLS AND CYLINDERS FOR USE IN PAPER MACHINES

[75] Inventor: Vaino Sailas, Vaajakoski, Finland

[73] Assignee: Valmet Paper Machinery, Inc., Helsinki, Finland

[21] Appl. No.: 173,993

[22] Filed: Dec. 28, 1993

Related U.S. Application Data

[60] Continuation-in-part of Ser. No. 898,550, Jun. 15, 1992, abandoned, which is a division of Ser. No. 692,312, Apr. 26, 1991, Pat. No. 5,140,749, which is a continuation of Ser. No. 455,582, Dec. 22, 1989, abandoned.

[30] Foreign Application Priority Data

Jan. 9, 1989 [FI] Finland ..... 890106

[51] Int. Cl.[6] ..... B30B 3/00

[52] U.S. Cl. ..... 492/38; 492/58; 29/895.2; 29/895.3

[58] Field of Search ..... 492/28, 36, 48, 57, 492/58, 38; 29/895, 895.2, 895.22, 895.3; 162/368, 372–374

[56] References Cited

U.S. PATENT DOCUMENTS

| | | | |
|---|---|---|---|
| 3,029,504 | 4/1962 | Nielsen | 29/425 X |
| 3,186,063 | 6/1965 | Dopp | 29/148.4 |
| 3,221,536 | 12/1965 | Seulen et al. | 29/895 X |
| 4,176,270 | 11/1979 | Sailas | 219/121 EM |
| 4,704,776 | 11/1987 | Wateinabe et al. | 29/132 |
| 4,748,736 | 6/1988 | Miihkinen | 29/132 X |
| 4,989,306 | 2/1991 | Leino et al. | 29/132 |
| 5,083,374 | 1/1992 | Miller | 29/895.2 |
| 5,111,567 | 5/1992 | Leino et al. | 29/132 |
| 5,123,152 | 6/1992 | Tenkula et al. | 29/132 |
| 5,140,749 | 8/1992 | Sailas | 29/895.2 |
| 5,273,512 | 12/1993 | Ducasse | 492/36 |

FOREIGN PATENT DOCUMENTS

| | | |
|---|---|---|
| 7198243 | 5/1981 | Japan . |
| 312328 | 2/1956 | Switzerland . |

OTHER PUBLICATIONS

Marks, "Standard Handbook for Mechanical Engineers", 8th Edition, McGraw Hill Book Company, pp. 13.48–13.51.

*Primary Examiner*—Tom Hughes
*Attorney, Agent, or Firm*—Steinberg, Raskin & Davidson

[57] ABSTRACT

A method for manufacturing a cylindrical mantle of rolls or cylinders of a paper machine out of a corrosion-proof metal or alloy material, particularly refined steel, in which oblong plate blanks are cut to a length equal to the total length of the roll mantle to be manufactured. The plate blanks are machined or bent to mantle portions of a cross-sectional shape equal to a part of a circular ring. Out of the mantle portions, the cylindrical mantle of a roll or cylinder is assembled by joining the mantle portions together by means of axial welding joints prepared by electron-beam welding performed in the vacuum chamber of an electron-beam apparatus by using a number of mantle portions per one roll mantle. A roll or cylinder manufactured by the method is also described.

10 Claims, 3 Drawing Sheets

ROLLS AND CYLINDERS FOR USE IN PAPER MACHINES

This application is a continuation-in-part of U.S. Ser. No. 07/898,550, filed Jun. 15, 1992, and now abandoned, which is a divisional of U.S. Ser. No. 07/692,312, filed Apr. 26, 1991, now U.S. Pat. No. 5,140,749, which is a continuation of U.S. Ser. No. 07/455,582, filed Dec. 22, 1989, now abandoned.

BACKGROUND OF THE INVENTION

The invention relates to a method for the manufacture of the cylindrical mantle of the rolls or cylinders of a paper machine out of a corrosion-proof metal or alloy material, particularly of refined steel, and particularly for the manufacture of the cylindrical mantle to be perforated for a suction roll of a paper machine.

The invention also relates to a roll or cylinder of a paper machine, in particular a suction roll provided with a perforated mantle, comprising a cylindrical mantle and end pieces attached to both of its ends, in connection with which end pieces there are the axle journals of the roll or cylinder.

Rolls of paper machines, inparticular suction rolls, operate in an environment which is highly corrosive. Moreover, suction rolls, in particular press rolls, are subjected to high dynamic loads, because at present the linear loads employed, e.g., in press rolls are of an order of from about 70 kN/m to about 120 kN/m or even higher. For this reason, in the mantles of suction rolls or the equivalent, it is necessary to use extensively alloyed special steels, such as two-phase, i.e. so-called duplex steels, which are expensive and difficult to work when cold. Problems of strength in the case of the mantles of suction rolls are also caused by the fact that their mantles are perforated, one mantle comprising typically about 500,000 suction holes.

The diameters of prior art suction rolls are generally of an order of from about 600 mm to about 1400 mm, and their wall thicknesses are between about 55 mm and about 90 mm, in the case of large paper machines usually between about 70 mm and about 90 mm. The lengths of the suction rolls correspond to the width of the paper machine, being usually within a range of from about 5 m to about 10 m.

The cylindrical mantles of suction rolls or equivalent for paper machines are, in prior art, manufactured by means of the following techniques. The cylindrical mantles are bent by being rolled out of a plate almost to the shape of a full circle or a semicircle, and the longitudinal joint or joints is/are welded together. Also, it is obvious that the mantles to be bent must have either a thin wall (such as an iron wall) or be formed from a readily yielding material (such as bronze). Mantles having a thick wall or formed from hard materials would not be useable in this type of prior art manufacturing process.

Correspondingly, it is known in the prior art to bend cylindrical mantles from a plate to a curved shape by chamfering to a semicircular shape, whereupon the longitudinal joints of the cylinder halves are welded together. Chamfering can, as a rule, be employed up to a mantle wall thickness of about 50 to about 70 mm only. Hereupon the cylindrical mantle made by rolling or chamfering is machined to cylindrical shape.

A particular drawback of the prior art mantle bending techniques, such as that described in U.S. Pat. No. 3,186,063 (Dopp), is that the bending of the flat mantles to a new larger radius of curvature causes tension in the inner surface of the mantle blank and compression in the outer surface of the mantle blank. This effect is an obvious result from the outward bending of the mantle blanks as described in the Dopp reference.

In the prior art, cylindrical mantles for paper machine rolls or cylinders are also manufactured by means of centrifugal casting. In this casting process, the casting mold is made to revolve in a horizontal position, e.g., on rolls, and molten metal is fed into the mold. The metal remains and solidifies on the mold walls by the effect of centrifugal forces.

Since the wall thicknesses of suction rolls and equivalent are quite high (between about 55 mm and about 90 mm), the rolling and chamfering of the plate material requires particularly robust equipment and high forces. In spite of this, for example when rolling is used, the roll mantle must be composed of axial parts of a length of about 2 m to about 3 m. With larger mantle thicknesses, higher than about 70 mm, rolling is not possible except by means of particularly robust equipment or by using very short mantle portions which are hot. Thus, with higher mantle thicknesses, it has been necessary to use chamfering, by which means it is, however, difficult to bring the mantle to precisely circular shape, which results in the drawback that large quantities of material must be machined off the mantle. This increases the time taken by the machining and the loss of material.

In a mantle manufactured by rolling or chamfering, it has been necessary to use transverse welding joints, which has resulted in the following drawbacks. In practice, it has been noticed that the major part of the suction rolls are broken down by breaking off so that mostly the breaking point is exactly at the location of a transverse weld when the roll has been manufactured by welding. The points of starting and ending of a transverse weld are particularly risky problem points. For this reason, one of the main objectives of the present invention is to provide a process for the manufacture of a roll mantle and a roll or cylinder manufactured by means of the method wherein there are no transverse joints at all.

It is a drawback in the use of centrifugal casting methods that about one half of the wall thickness must be machined before a "sound" roll mantle is obtained. It is a further drawback that casting flaws tend to remain in the roll mantle, and these flaws constitute starting points for fractures. A considerable drawback is the above proportion of material lost on machining because the extensively alloyed steels used in roll mantles are very expensive.

It is another particular drawback of a centrifugal casting process that there is an inherent limit on the type of material that can be used, i.e., it must be a material which is suitable for centrifugal casting. Since rolls or cylinders used in paper manufacturing methods are subjected to high dynamic loads, the mantle of the rolls or cylinders must have a relatively thick walls which are difficult to provide using a centrifugal casting technique.

OBJECTS AND SUMMARY OF THE INVENTION

Accordingly, it is an object of the present invention to provide a novel method and a paper machine cylinder and roll manufactured by means of the method, in particular a suction roll provided with a perforated mantle, wherein the drawbacks mentioned above and those that will come out later can be avoided for the most part.

Another object of the present invention is to provide a method for the manufacture of mantles for paper rolls or cylinders out of a corrosion-proof metal or alloy material, particularly refined steel, by means of which method the manufacture of the mantle can be carried out with maximal economy in consideration of the cost of the material of the mantle to be manufactured, of the time of manufacture, of the stock of machines required, and of the energy cost.

It is another object of the present invention to provide a new and improved roll construction in which the roll mantle, and thus the mantle blanks, does not have excessive tension and compression forces in its exterior surfaces. This eliminates problems when the mantle blanks are formed into the roll which is subjected to high dynamic pressures when in use. Otherwise, a roll mantle having high internal tension and compression forces on the inner and outer surfaces thereof might break or cause unwanted problems in the use of the roll when it is subjected to high pressures.

It is still another object of the present invention to provide a new and improved roll construction in which the roll mantle, and thus the mantle blanks, are formed from any material whatsoever, preferably substantially entirely from extensively alloyed two-phase steel, e.g., a Cr—Ni alloyed refined steel, which is not limited in its thickness or composition by the limitations of the process used to make the roll.

In order to achieve the objects stated above and others, the method of the invention comprises a combination of the following steps:

a) cutting oblong plate blanks of a length equal to the total length of the roll mantle to be manufactured out of corrosion-proof metal or alloy material, particularly out of refined-steel plate material;
b) machining the plate blanks to mantle portions of a cross-sectional shape equal to a part of a circular ring;
c) assembling the cylindrical mantle of a roll or cylinder out of the mantle portions by joining the mantle portions together by means of axial welding joints prepared by electron-beam welding performed in the vacuum chamber of an electron-beam apparatus, by using at least 6 pcs., most appropriately 10–16 pcs., preferably at the maximum 70 pcs., of mantle portions per one roll mantle;
d) machining the roll mantle to cylindrical shape at least on the outside, most appropriately both on the inside and on the outside.

The roll and cylinder in accordance with the invention is mainly characterized in that the roll or cylinder comprises a cylindrical mantle which is composed of, most appropriately 6–20, preferably at the maximum about 70, oblong axial parts, which mantle portions are joined together without transverse joints by means of unified longitudinal axial joints extending over the entire length of the roll mantle and prepared by means of electron-beam welding.

In the invention the roll or cylinder mantle is composed of a number of oblong plate pieces of a length equal to the length of the whole roll mantle, which pieces have, most appropriately, been first machined to mantle portions of a shape equal to a part of a circular ring. Generally, between 6 and 20, most appropriately between 10 and 16 machined blanks are used per roll mantle. In some special cases, when the wall thickness of the roll manufactured by means of the method in accordance with the invention is of an order of from about 40 mm to about 70 mm, it is possible to bend the plate pieces of a length equal to the length of the whole roll mantle first to the shape of a part of a circular ring, and in such a case, in one mantle, it is possible to use, e.g., only 4–6 plate blanks.

It is an important feature of the present invention that the plate blanks are welded together by means of welding joints parallel to the axial direction of the roll expressly by means of electron-beam welding (EB-welding).

When EB-welding is applied to the invention, at one time, several advantages of different types as well as synergy are obtained. Of these advantages it should be mentioned that, when EB-welding is used, the thermal energy that is required is only about one hundredth as compared with conventional welding methods, whereby the deformations of the roll mantle can be made small in spite of the high total length of the welding joint. This property of EB-welding results from the high energy density in EB-welding. When EB-welding is used, the requirement of after-machining of the roll mantle becomes little, because there is small burring at a joint made by EB-welding. Moreover, by means of an electron beam, an excellent quality of the welding joint as well as, in the invention, a reasonable welding speed are obtained, when considering the relatively large length of welding joint needed per roll. The EB-welding can be carried out from inside and/or from outside the roll mantle. It is a further advantage that EB-welding can usually be carried out without using filler materials, even though, in some special cases, filler materials may be used. When EB-welding is used, the welding parameters can be determined precisely and, as is shown by the example to be given later, in the manufacture of the roll mantle the welding time does not become excessively long or even a decisive factor, but the time taken by the machining of the plate blanks is even longer.

When the invention is applied, it is preferable to bind the plate blanks together by means of a special tool, whereupon the EB-welding is carried out in a way known in the prior art in a vacuum chamber from inside and/or from outside the roll mantle by means of one or several welding heads travelling in the axial direction of the roll.

In the invention, the number of the plate blanks to be used is chosen by performing a process of optimization with respect to the costs of the machining, in consideration of the loss of material arising in said machining, and with respect to the sum of the costs of the EB-welding. In such a case, the conclusion is that the roll mantle is composed of 6–20 parts, most commonly of 10–16 parts. In the case of large objects, e.g. a Yankee cylinder (diameter of an order of about 10 m) the number of the parts may, of course, exceed these numbers (the number being, 60–70 pcs.). When a roll mantle material of lower cost is used, it is possible to use six plate blanks, in which case the loss of material becomes higher, but the length of the welding joint is reduced accordingly. The higher the cost of the roll mantle material that is used, the higher the number of plate blanks that can be optimally used.

The advantages provided by the invention are particularly pertinent in the manufacture of suction rolls for a paper machine. However, by means of the method in accordance with the invention, it is also possible to manufacture cylinders for a paper machine, such as drying cylinders or Yankee cylinders, as well as various solid-mantle rolls for a paper machine, such as center rolls for a press.

By means of the method in accordance with the invention, the roll mantles are made of corrosion-proof and weldable metal or alloy materials, particularly extensively alloyed stainless steels, often so-called two-phase or duplex steels, such as CrNi-alloyed steels with a low content of carbon.

BRIEF DESCRIPTION OF THE DRAWINGS

In the following, the invention will be described in detail with reference to some advantageous exemplifying embodiments of the invention illustrated in the figures in the accompanying drawing, the invention being by no means strictly confined to said embodiments.

DETAILED DESCRIPTION OF THE INVENTION

Figure 2:
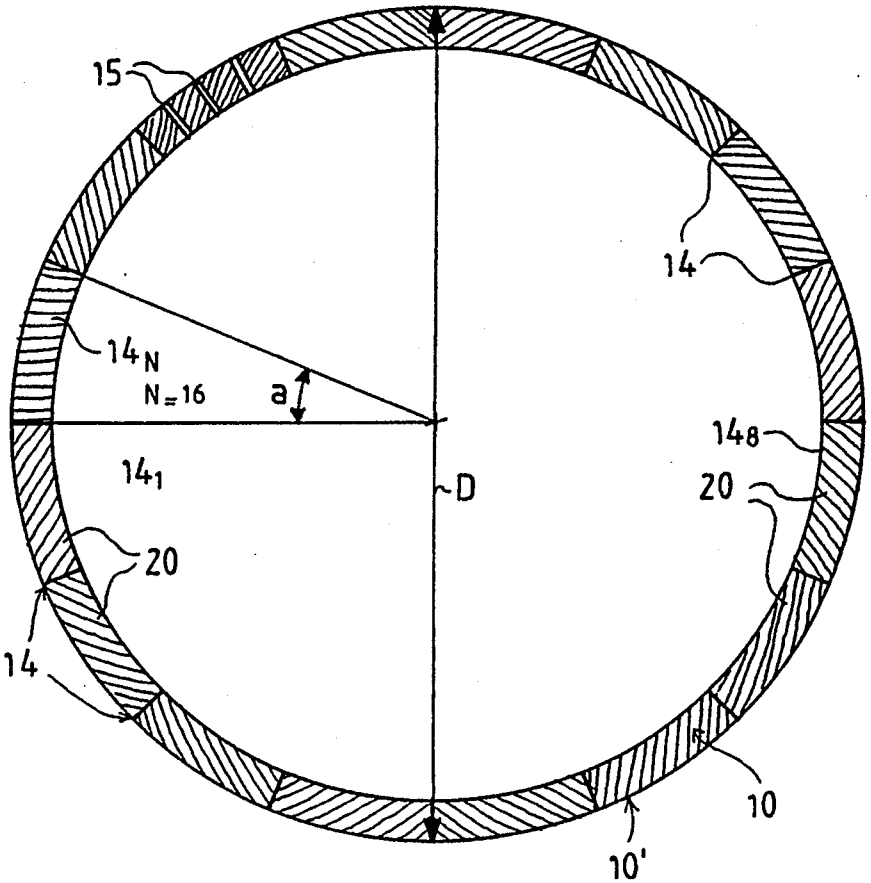
FIG. 2 is a sectional view taken along the line II—II in FIG. 1.
Figure 1:
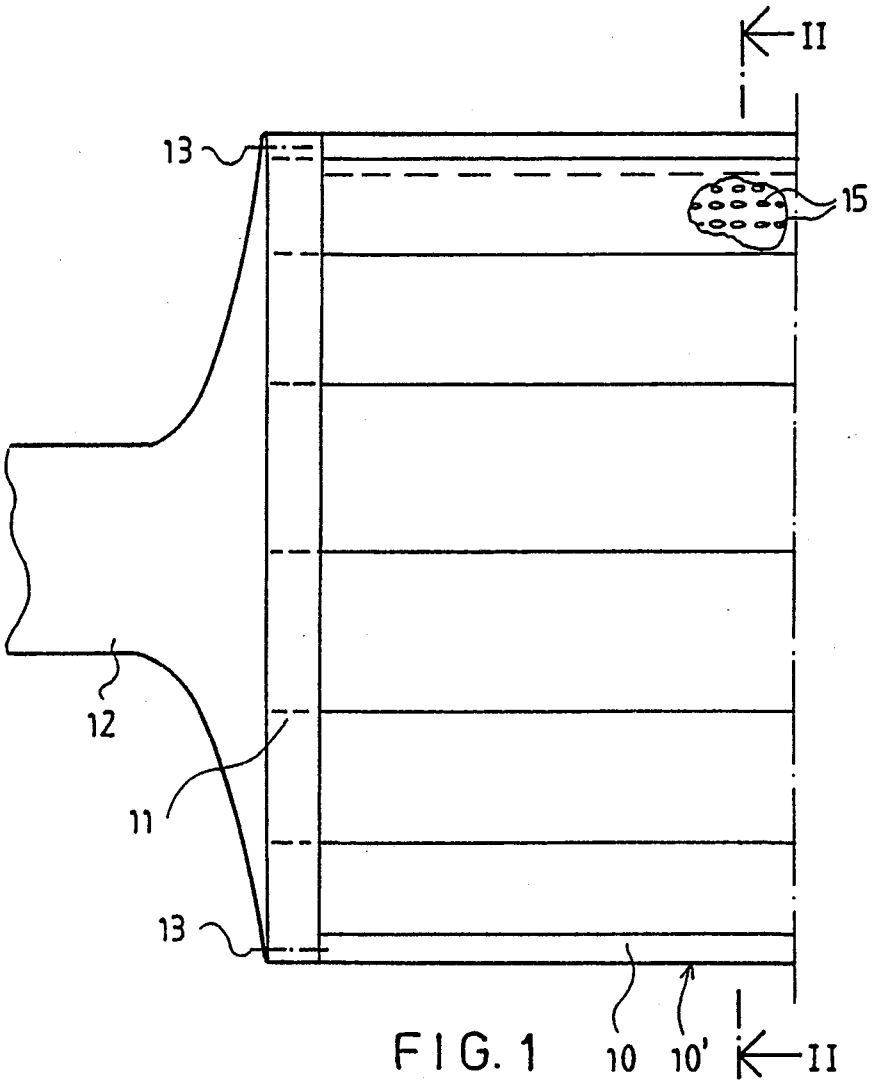
FIG. 1 is a schematical illustration of a portion of a suction roll manufactured by means of the method of the invention.

FIGS. 1 and 2 are schematical illustrations of a suction roll manufactured by means of the method in accordance with the present invention. The suction roll comprises a mantle 10, which has an outer face 10' which has been machined smooth. The mantle 10 is provided with a through perforation 15, which operates as the suction duct between the suction-box (now shown) provided inside the suction roll and the outside atmosphere. Ends 11 have been attached to both ends of the mantle 10 of the suction roll by means of screws 13 or equivalent, these ends being provided with axle journals 12.

Figure 3:
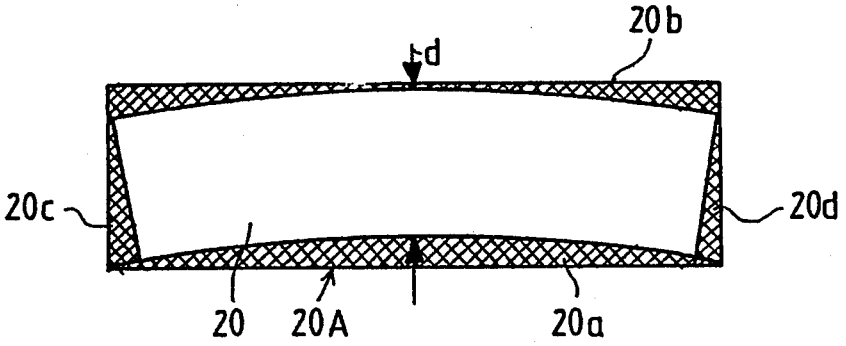
FIG. 3 shows a cross-section of a plate blank used in the invention.

The roll mantle 10 shown in FIGS. 1 and 2 is manufactured by means of the method in accordance with the invention, e.g., as follows. Plate blanks 20A of a cross-sectional shape of a rectangular prism and of a length equal to the length of the whole roll mantle 10 are cut out of a plate of suitable thickness d. The plate blanks 20A are machined by milling and/or by planing so that the plate blank 20A is converted to mantle portions 20 of the shape equal to a part of a circular ring and of a length equal to the length of the whole roll mantle. In FIG. 3, the inner part **20*a*, the outer part 20*b*, and the side parts 20*c* and 20*d* to be machined off the plate blank 20A** are indicated by means of crosswise shading.

The machining process, by which the plate blanks 20A are machined, is designed so that the process does not induce any additional stresses in the plate blank. Thus, after the plate blanks are machined to the desired shape, the resulting outer convex surface and inner concave surface of the plate blanks will be at substantially the same stress level. The stress level will be that of the plate blank 20A at a minimal stress level causes solely by the machining process, since the outer and inner surfaces are not physically deformed, bent or extended in any way. Rather, the inner and outer surfaces are formed by milling or planing away excess material to arrive at the desired cylindrical form.

It is an important feature of the present invention that the inner and outer surfaces of each axial mantle portion are at substantially the same stress level. This is an important property in a large paper machine press roll, which may have a diameter of about ten meters and a length of about between 8 to 10 meters, and which might be subjected to linear loads in the range of 70 to 120 kN/m in a press nip. As a result of this construction, during use of the roll mantle in accordance with the invention, excessive mantle stresses in addition to those that occur during normal pressing operations are avoided as such can be detrimental to the roll operation.

According to FIGS. 1 and 2, the number of mantle portions 20 used per roll mantle 10 is 16 pcs., and in FIG. 2 said parts are denoted with the reference numerals $14_1$–$14_N$. As was stated above, N is selected to be between 6 and 20, most appropriately N is between 10 and 16. When N equals 16, the central angle a of one mantle portion 20 is 22.5°. In the case of very large objects, such as Yankee cylinders, the central angle may also be smaller, e.g., about 5°–18°.

The above sixteen (16 pcs.) mantle portions 20 of a length equal to the length of the whole roll mantle are assembled in a tool made for the purpose as a closed cylinder mantle. The mantle blank assembled in this way is transferred into the vacuum chamber in the EB-welding machine, and the welding together of the mantle portions 20 by means of axial joints 14 is carried out by means of the EB-welding device shown in FIGS. 4 and 5, whereby the axial joints 14 are formed in the mantle 10, these joints being continuous and having a length equal to the entire length of the roll mantle 10.

Figure 3A:
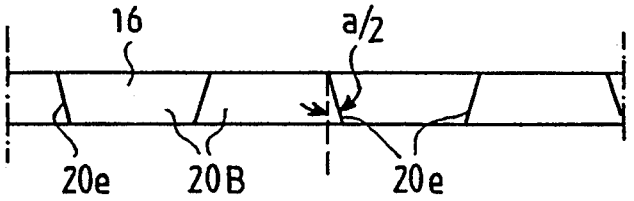
FIG. 3A shows a cross-sectional view of an alternative method of cutting of a plate blank.

FIG. 3A illustrates an alternative method of cutting the plate 16 into the plate blanks 20B used in the invention. According to FIG. 3A, the plate blanks 20B are cut to trapezoidal section so that the angle of the cuts **20*e* corresponds to the central angle a of the mantle portion 20 made of the blank 2O*a*. Out of the plate parts in accordance with FIG. 3A, the mantle blank can be assembled without machining, and the machining of the mantle from inside and from outside to circular shape is carried out only after the parts 20** have been welded together by means of EB-welding joints.

In some special cases, in particular when N is quite large, the invention can also be carried out so that only the lateral machinings **20*c* and 20*d* are performed on the plate blank 20*a*, whereas the machining 20*b* of the outside, and possibly also the machining 20*a* of the inside, is carried out only after the creation of joint 14** by means of EB-welding, most appropriately in the same way as the mantle is after-machined.

After the mantle in accordance with the invention has been assembled out of its parts 20, its heat treatment is carried out in a manner known in the prior art. The heat treatment takes place most appropriately when the mantle is placed standing vertically, so that no detrimental deformations or strains are formed in it. In the following, two non-restrictive examples will be given on suitable welding parameters and on the speed of preparation of the joint 14 obtained by means of these parameters.

Figure 4:
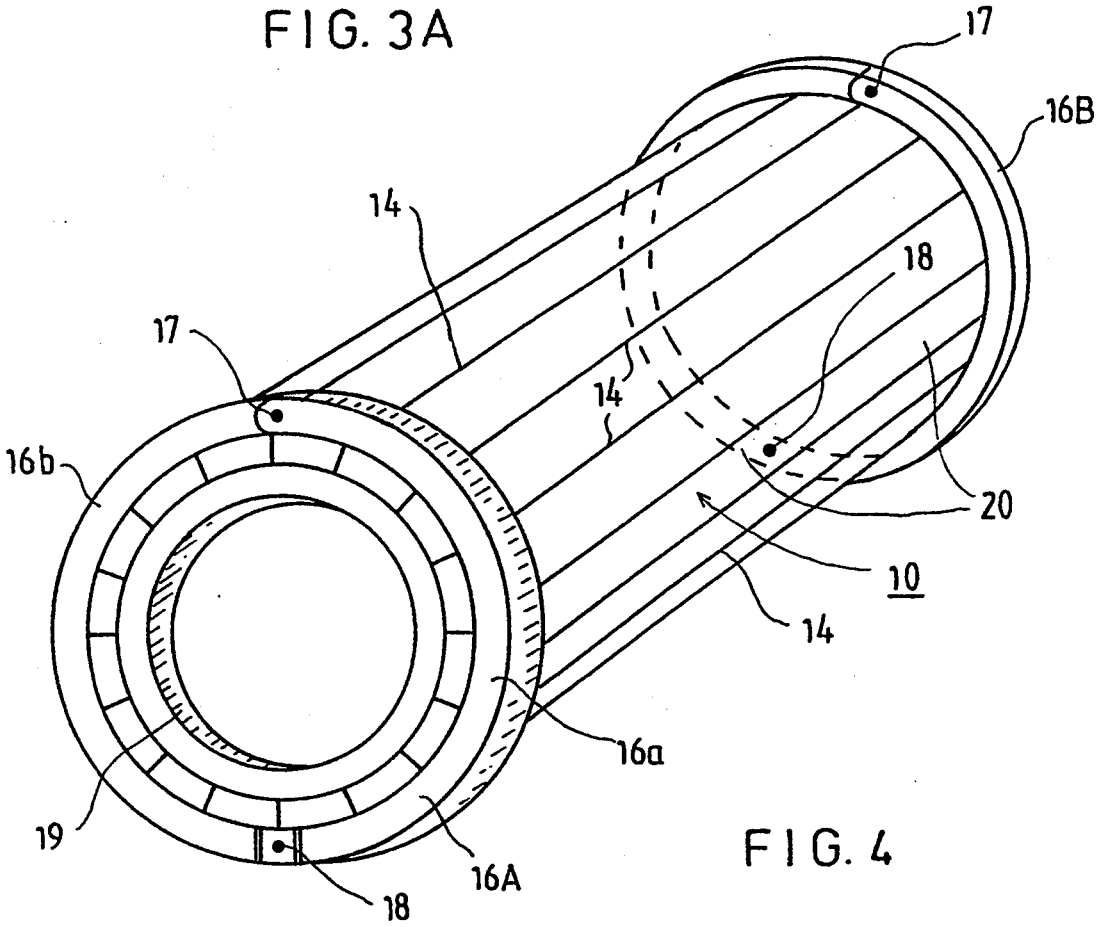
Figure 4 shows a roll blank assembled out of mantle portions before the stage of EB-welding.

As is shown in FIG. 4, the roll parts 20 have been assembled into a roll-mantle blank 10 by making use of inner rings 19 and of outer rings 16A and 16B. The outer rings 16A and 16B consist of two parts **16*a* and 16*b*, which are connected to each other, e.g., by means of shaft pins 1 and/or 18. The parts 16*a* and 16*b* of the outer rings 16A and 16B can be tightened, e.g., by means of a suitable hydraulic tool (not shown). Owing to the rings 16A and 16B, for example an area of about 2×20 mm remains unwelded at the ends of the mantle 10, but this is only about 0.5 percent of the entire mass of the roll mantle 10**.

Figure 5:
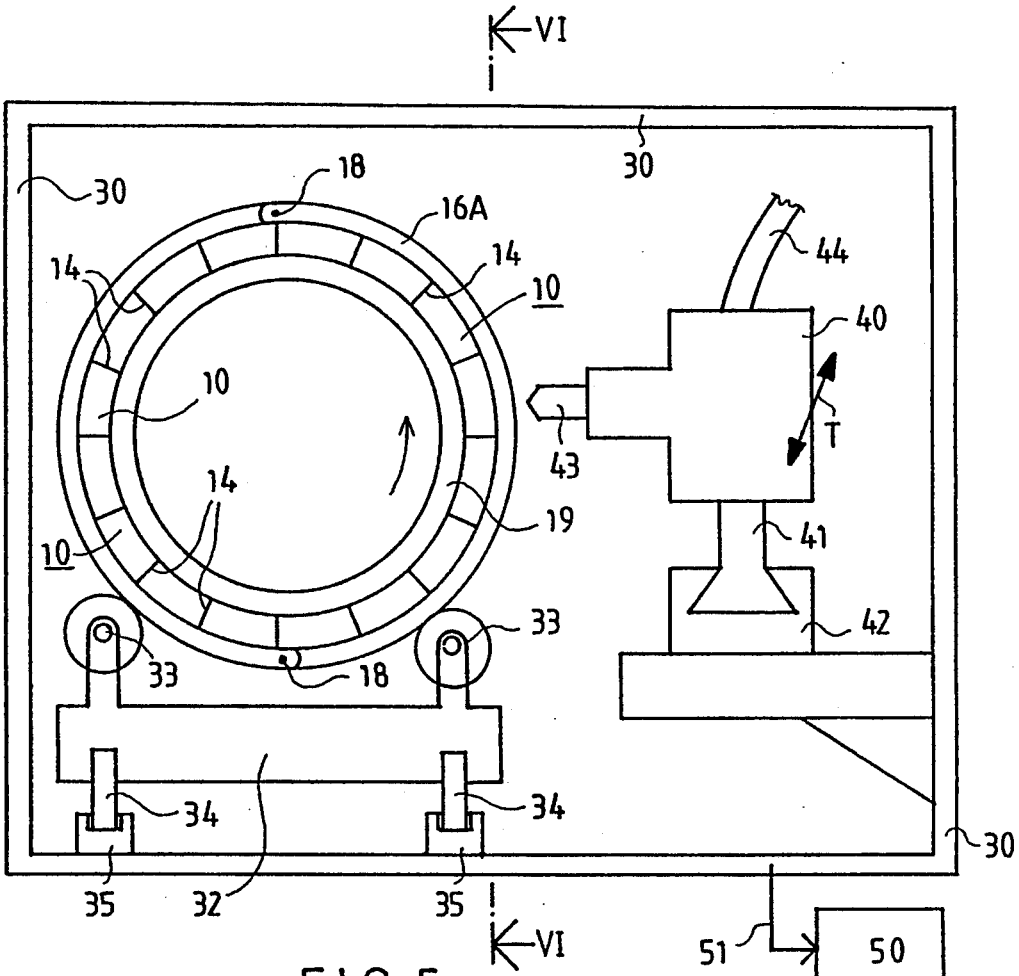
FIG. 5 is a vertical cross-sectional view of an EB-welding device applied in the invention, in whose interior the roll mantle to be welded is fitted.
Figure 6:
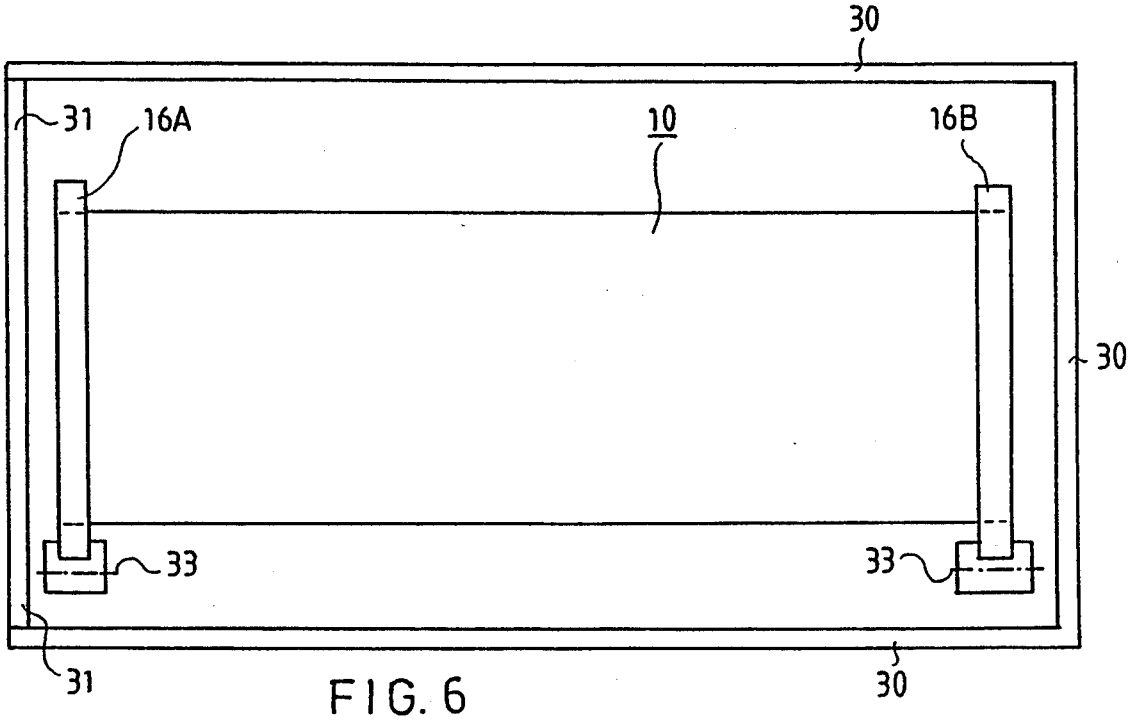
FIG. 6 is a vertical sectional view along the line VI—VI in FIG. 5.

The blank shown in FIG. 4, together with its fastening members 16A, 16B and 19, is lifted onto a carriage 32 having two pairs of rolls 33, 34. The rolls 33 are provided with grooves corresponding to the outer-ring parts 16A and 16B so that the roll-mantle blank 10 can be rotated on the pairs of rolls 33 while supported by means of the ring parts 16A and 16. The carriage 32 is pushed through the door 31 of the vacuum chamber 30 into the vacuum chamber 30 on the rails 35 and the carriage wheels 34. In the vacuum chamber 30, an EB-welding device 40 is placed, which travels on the guide 42 and on a corresponding projection part 41 across the entire axial length of the roll blank 10. The EB-welding device 40 is provided with a welding head 43, which has a suitable accelerating voltage U in relation to the mantle blank 10. The necessary DC electric power is supplied through the cable 44 from a suitable source of DC electricity (not shown). The EB-welding is carried out by means of the device described above so that the mantle blank 10 is rotated on the rolls 30 and locked in its position so that the joint area 14 between the parts is placed facing the welding head 43. Hereupon the voltage U is switched on to the welding head 43, and the joint 14 is prepared by means of electron-beam welding while the EB-device 40 traverses across the entire roll mantle over the distance between the outer-ring parts 16A and 16B. After one joint 14 has been completed, the roll blank is rotated again to the position of the next joint 14, and the EB-welding device 40 traverses in the opposition direction and prepares the second joint. This is continued until all the joints 14 have been prepared, whereupon the roll mantle 10 is transferred on the carriage 32 out of the welding chamber and is turned to a vertical position for the purpose of the heat-treatment stage in itself known. FIG. 5 shows schematically a vacuum pump 50, which sucks a suitable vacuum level into the chamber 30 through the pipe 51.

In the following examples,

W=output of electron gun in the welding head of the EB-device;

d=wall thickness of mantle to be welded;

U=accelerating voltage of electron gun;

I=welding current; and v=speed of preparation of joint 14 between the parts 20.

Example 1

W=30 kW
d=100 mm
U=150 kV
I=180 mA
v=0.5 m/min.

Example 2

W=40 kW
d=100 mm
U=100 kV
I=40 mA
v=0.1 m/min.

In using the invention, electron-beam welding is preferable to conventional welding also because the thermal energies produced in this welding are only about one hundredth of the thermal energies produced in conventional methods, for which reason the deformations arising in the roll mantle because of the welding are within permitted limits.

The composition of the roll mantles is a corrosion-proof and weldable metal or alloy materials, particularly extensively alloyed stainless steels, often so-called two-phase or duplex steels, such as CrNi-alloyed steels with a low content of carbon. In a most preferred embodiment, each mantle portion is formed substantially entirely of the extensively alloyed two-phase steel and has an arcuate transverse cross-section. The inner concave surface and the outer convex surface are formed by removing excess material from the mantle portions by e.g., a machining process, so that they have substantially the same stress level.

The material of the plate blanks may also be hard and resistant to wear as it is not necessary that it be yielding or thin as no bending is performed on the plate blanks 20A.

In the following, the patent claims will be given, whereby the various details of the invention may show variation within the scope of the inventive idea defined in these claims.

What is claimed is:

1. A roll or cylinder for use in a paper machine, said roll or cylinder comprising:

a cylindrical mantle;

two end pieces attached respectively to opposite ends of said cylindrical mantle;

two axle journals attached respectively to each end piece; and wherein said cylindrical mantle comprises a plurality of axial mantle portions, each mantle portion being formed substantially entirely of extensively alloyed two-phase steel and having an arcuate transverse cross-section, an inner concave surface and an outer convex surface, said inner and outer surfaces being at substantially the same stress level, said axial mantle portions being joined together at respective electron beam welded longitudinal axial joints extending over an entire length of said cylindrical mantle.

2. The roll or cylinder of claim 1, wherein said two-phase steel is a Cr—Ni alloyed refined steel.

3. The roll or cylinder of claim 1, wherein said inner surface and said outer surface are not subjected to compression or tension stresses before said axial mantle portions are welded together.

4. A cylindrical mantle for a roll or a cylinder of a paper machine manufactured by a method comprising the steps of:

cutting a plurality of plate blanks out of a planar plate of corrosion-proof metal or alloy material, said blanks, after being cut, being of a length substantially equal to a length of said cylindrical mantle;

milling or planing said cut plurality of plate blanks until each plate blank has a transverse arcuate shape corresponding to a cylindrical portion of an assembled cylindrical mantle; said milling or planing step being performed such that an inner concave surface and an outer convex surface of said cut plurality of plate blanks have substantially the same stress level; and electron-beam welding together adjacent ones of said milled or planed plurality of plate blanks to form said cylindrical mantle.

5. The cylindrical mantle of claim 4 wherein said plate blanks of said mantle are substantially entirely made of extensively alloyed two-phase steel.

6. The cylindrical mantle of claim 5 wherein said two-phase steel is a CrNi alloyed refined steel.

7. A roll or cylinder for use in a paper machine, said roll or cylinder comprising a cylindrical mantle including a plurality of axial mantle portions, each mantle portion being formed substantially entirely of extensively alloyed two-phase steel and having an arcuate transverse cross-section, an inner concave surface and an outer convex surface, said inner and outer surfaces being at substantially the same stress level, said mantle portions being joined together at respective electron beam welded longitudinal axial joints extending over an entire length of said cylindrical mantle.

8. The roll or cylinder of claim 7, wherein said two-phase steel is a Cr—Ni alloyed refined steel.

9. The roll or cylinder of claim 7, wherein said inner surface and said outer surface are not subjected to compression or tension stresses before said mantle portions are welded together.

10. The roll or cylinder of claim 7, wherein said roll or cylinder comprises from about 6 to about 20 of said mantle portions.

* * * * *